US011710910B2

(12) United States Patent
Novak et al.

(10) Patent No.: US 11,710,910 B2
(45) Date of Patent: Jul. 25, 2023

(54) FIELD TERMINABLE SINGLE PAIR ETHERNET CONNECTOR

(71) Applicant: Panduit Corp., Tinley Park, IL (US)

(72) Inventors: Benjamin S. Novak, Lockport, IL (US); Satish I. Patel, Roselle, IL (US); Sean W. Lenz, Countryside, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 17/271,889

(22) PCT Filed: Sep. 5, 2019

(86) PCT No.: PCT/US2019/049764
§ 371 (c)(1),
(2) Date: Feb. 26, 2021

(87) PCT Pub. No.: WO2020/051340
PCT Pub. Date: Mar. 12, 2020

(65) Prior Publication Data

US 2021/0344126 A1 Nov. 4, 2021

Related U.S. Application Data

(60) Provisional application No. 62/727,189, filed on Sep. 5, 2018.

(51) Int. Cl.

| | |
|---|---|
| ***H01R 4/2433*** | (2018.01) |
| ***H01R 13/502*** | (2006.01) |
| ***H01R 13/58*** | (2006.01) |
| ***H01R 24/64*** | (2011.01) |

(52) U.S. Cl.
CPC ..... *H01R 4/2433* (2013.01); *H01R 13/502* (2013.01); *H01R 13/5825* (2013.01); *H01R 13/5829* (2013.01); *H01R 24/64* (2013.01); *H01R 2201/04* (2013.01)

(58) Field of Classification Search
CPC .. H01R 4/2433; H01R 4/2412; H01R 4/2404; H01R 13/6592; H01R 13/6593; H01R 9/032; H01R 13/502; H01R 13/5825; H01R 13/5829; H01R 24/64; H01R 2201/04
USPC ..... 439/409, 410, 607.41–607.52
See application file for complete search history.

(56) References Cited

U.S. PATENT DOCUMENTS

| | | | |
|---|---|---|---|
| 2,673,968 | A | 3/1954 | Smith |
| 4,975,078 | A | 12/1990 | Stroede et al. |
| 4,995,830 | A | 2/1991 | Eckhaus |
| 5,226,835 | A | 7/1993 | Baker, III et al. |
| 5,947,761 | A | 9/1999 | Pepe |

(Continued)

FOREIGN PATENT DOCUMENTS

| | | | |
|---|---|---|---|
| EP | 2755281 | A1 | 7/2014 |
| WO | 9966598 | A1 | 12/1999 |

*Primary Examiner* — Gary F Paumen
(74) *Attorney, Agent, or Firm* — Christopher S. Clancy; James H. Williams; Christopher K. Marlow

(57) ABSTRACT

A communication connector has an outer housing with an opening, a shielding wrap at least partially enclosing the outer housing, and a contact carrier assembly configured to be interested into the opening of the outer housing. The contact carrier assembly at least partially encloses at least two contacts each with an insulation displacement contact (IDC). The contact carrier assembly also has an integrated wire cap that utilizes a hinge feature to press cable conductors of a cable into their respective IDCs.

1 Claim, 8 Drawing Sheets

(56) References Cited

U.S. PATENT DOCUMENTS

| | | | | |
|---|---|---|---|---|
| 6,080,006 | A | 6/2000 | Broder | |
| 6,270,372 | B1 | 8/2001 | Jenner et al. | |
| 6,682,363 | B1 | 1/2004 | Chang | |
| 6,783,386 | B2 | 8/2004 | Clement | |
| 7,066,764 | B2 | 6/2006 | Bolouri-Saransar | |
| 7,540,789 | B2 * | 6/2009 | Gerber | H01R 4/2429 439/676 |
| 7,572,140 | B2 | 8/2009 | Szelag et al. | |
| 8,192,224 | B2 | 6/2012 | Schmidt et al. | |
| 8,702,444 | B2 * | 4/2014 | Maranto | H01R 13/5825 439/418 |
| 9,960,549 | B2 | 5/2018 | Strelow et al. | |
| 2008/0057793 | A1 | 3/2008 | Gerber et al. | |
| 2009/0142968 | A1 | 6/2009 | Goodrich et al. | |
| 2012/0094525 | A1 | 4/2012 | Maranto et al. | |

* cited by examiner

FIELD TERMINABLE SINGLE PAIR ETHERNET CONNECTOR

CROSS REFERENCE TO RELATED APPLICATIONS

This application claims priority to U.S. Provisional Application No. 62/727,189, filed Sep. 5, 2019, the subject matter of which is hereby incorporated by reference in its entirety.

FIELD OF THE INVENTION

The present invention is a means of terminating a single pair ethernet cable to a connector that both establishes electrical continuity and provides strain relief for the cable. The invention also incorporates shielding features to improve electrical performance of the connector.

BACKGROUND OF THE INVENTION

Copper connectors are becoming increasingly compact in an effort to achieve a higher density of data channels in a given area, as well as for use in applications where data needs to be transmitted to remote devices, such as security cameras and climate control devices. These compact connectors are generally required to be installable onto cable in the field using simple hand operated tools. Typically, for an ethernet data connection, a four pair cable solution would be deployed using RJ45 jacks as the interconnection. However the full bandwidth of a Cat 6a is not necessary for low bandwidth applications such as, but not limited to, security cameras and other smart building devices. In this case, a single twisted pair cabling solution can be deployed that will save material costs as well as reduce the amount of space used by the structured cabling system. With the recent advancements of ethernet bandwidths using copper media, the data throughput will be adequate for most smart devices. The field terminable design provides an advantage by allowing installers to build custom cabling structures and only using the necessary amount of cable for the end user's application. This customization eliminates the need for additional cabling management techniques which saves time and resources for field technicians deploying the structured cabling system.

Industrial and building automation applications have long used single pair cable systems to deliver power and very low bandwidth data transmission. The typical deployment of this cable would be terminated to screw terminals. The single pair connector proposed in this document offers a standardized way to deploy a low cost data and power delivery system to accomplish the same requirements as is used today and supported by the IEEE 802.3cg standard. The single twisted pair copper solution leverages the industry's knowledge of ethernet data transmission as well as POE (power over ethernet) capabilities to achieve a reliable and robust solution.

What is needed is a termination design that can be adapted to a small form factor that is simple and inexpensive to manufacture as well as quickly and easily terminated by an installer without complex and expensive tools. The design needs to accommodate both screened and unscreened cable in various gauges.

SUMMARY

A communication connector has an outer housing with an opening, a shielding wrap at least partially enclosing the outer housing, and a contact carrier assembly configured to be interested into the opening of the outer housing. The contact carrier assembly at least partially encloses at least two contacts each with an insulation displacement contact (IDC). The contact carrier assembly also has an integrated wire cap that utilizes a hinge feature to press cable conductors of a cable into their respective IDCs.

DETAILED DESCRIPTION OF THE INVENTION

Figure 1:
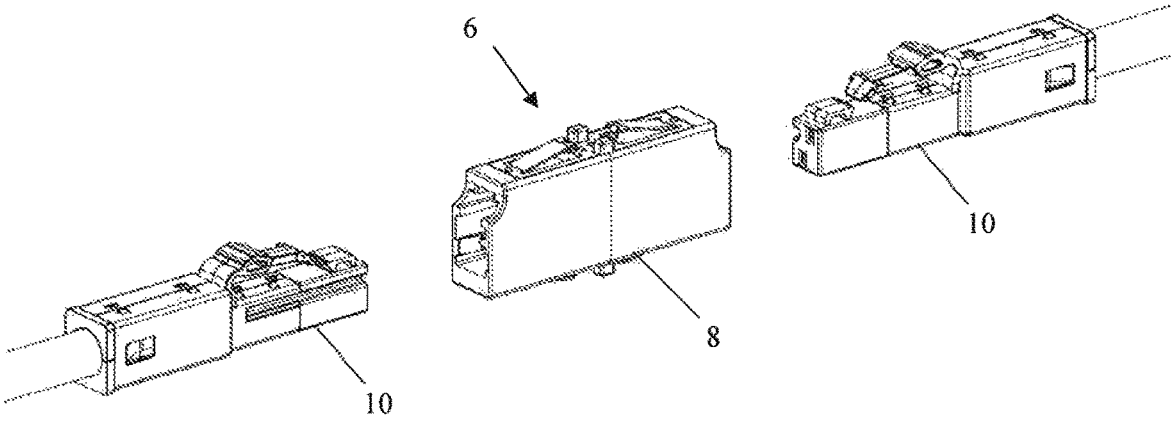
FIG. 1 shows an isometric view of two single pair ethernet connectors joined by a coupler.

FIG. 1 illustrates a communications channel 6 having two single pair ethernet connectors 10 joined by a coupler 8. Though a coupler is shown, the single pair ethernet connectors can be used with active or passive devices, including but not limited to patch panels, wall jacks, ethernet switches, routers, servers, and power-over-ethernet devices. The communications channel 6 can be located in cabinets, racks, zone enclosures and other such infrastructure.

Figure 2:
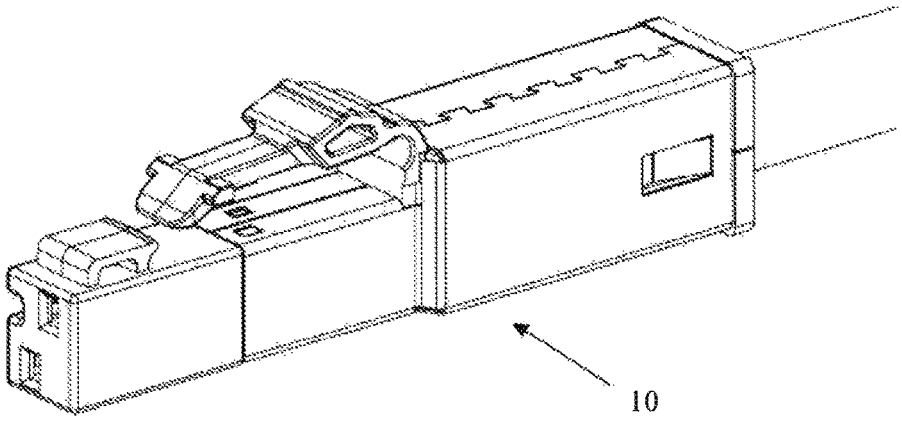
FIG. 2 shows an isometric view of a single pair ethernet connector.
Figure 3:
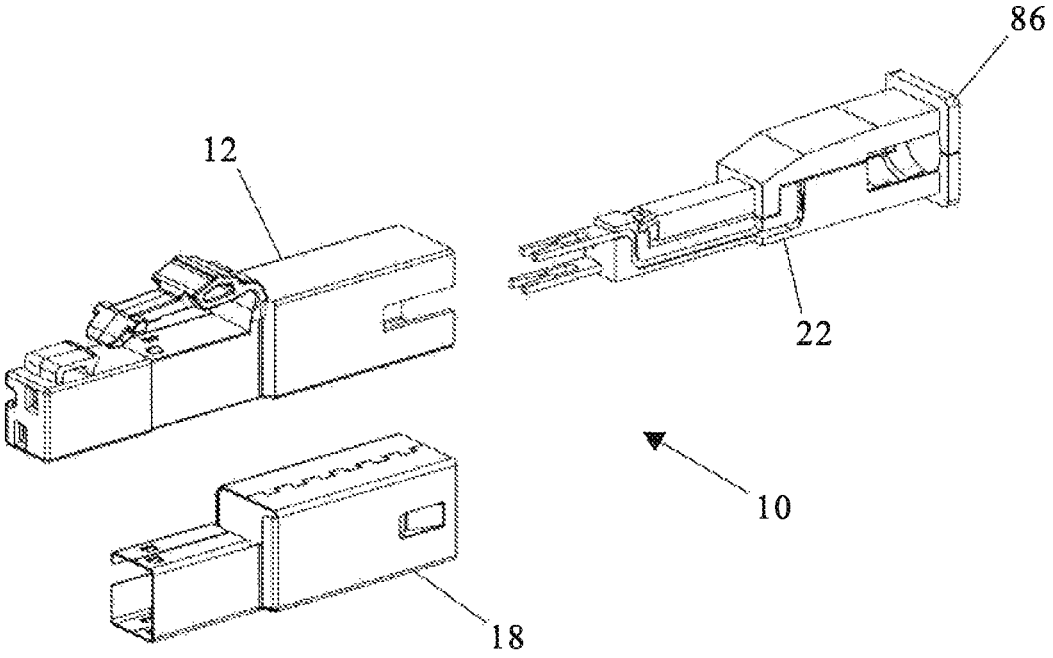
FIG. 3 is an exploded isometric view of the single pair ethernet connector of FIG. 2.

FIGS. 2 and 3 show a single pair ethernet connector 10 having an outer housing 12, shielding wrap 18, and contact carrier assembly 22.

Figure 4:
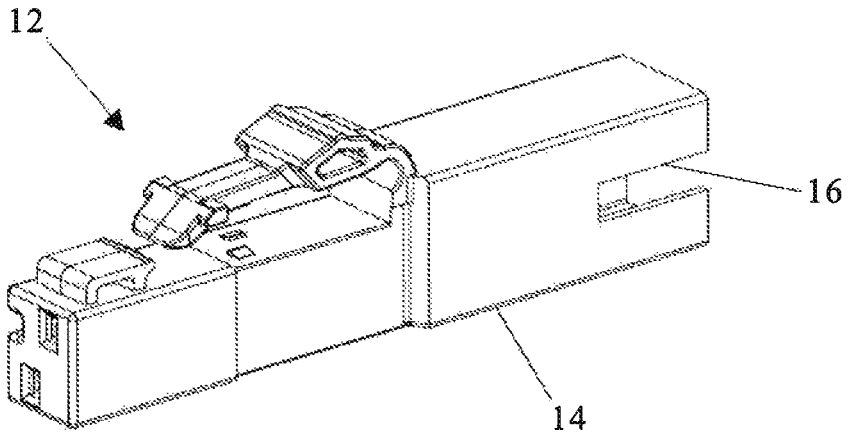
FIG. 4 is an isometric view of the single pair ethernet connector of FIG. 2 without the cable.

The outer housing 12 is shown in FIG. 4. The outer housing 12 has a termination area 14 that encloses the contact carrier. The termination area can have shield tab reliefs 16 to allow for the shielding wrap to contact the cable screen for grounding.

Figure 5:
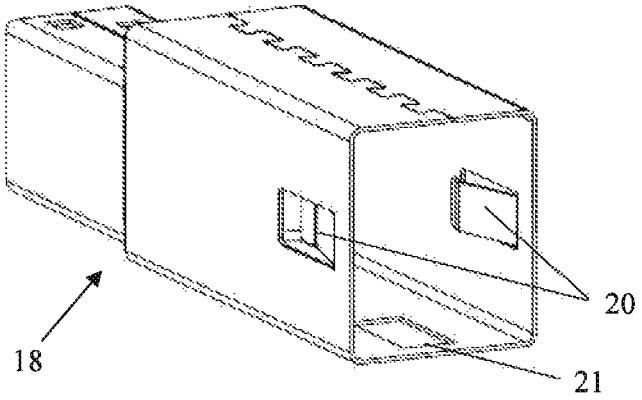
FIG. 5 is an isometric view of the shielding wrap of the single pair ethernet connector of claim 2.

Shielding wrap 18 is shown in FIG. 5. The shielding wrap encloses the termination area of the outer housing and will be manufactured from metal to reduce the effects of alien crosstalk from adjacent connectors. The shielding wrap features grounding tabs 20 designed to contact the shielding screen of the single pair ethernet cable. Slot 21 engages with a latch in the contact carrier to lock the carrier into the connector housing.

Figure 6:
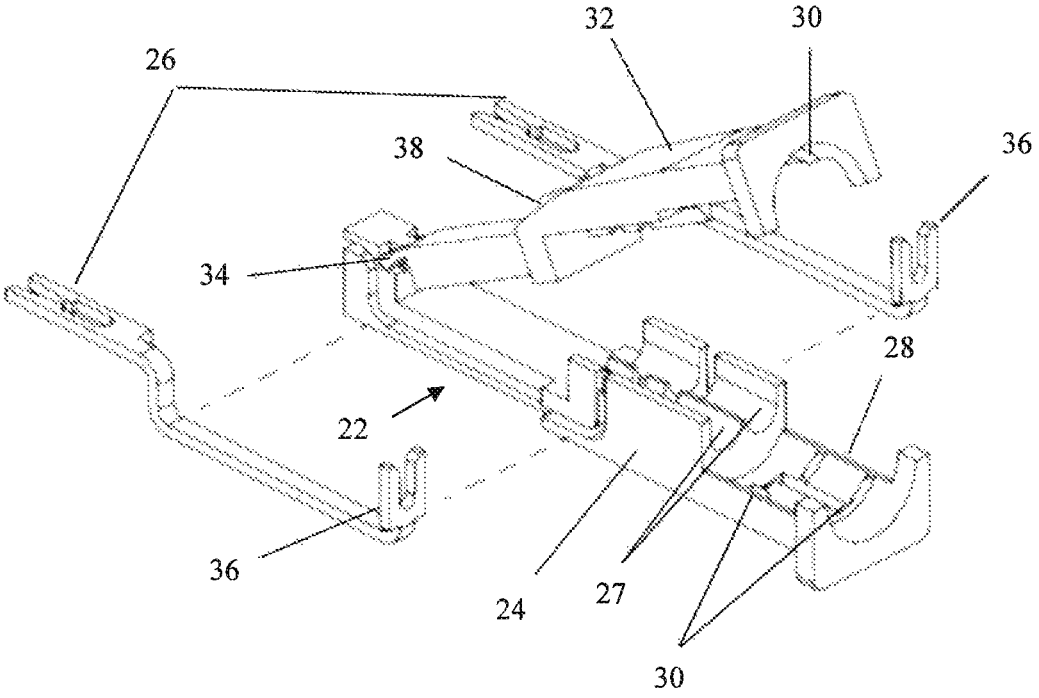
FIG. 6 is an isometric view of the contact carrier assembly of the single pair ethernet connector of FIG. 2.

An exploded view of contact carrier assembly 22 is shown in FIG. 6. The carrier assembly is comprised of molded plastic main body 24 that holds two copper contacts 26 in place. Channels 27 help locate the conductors of the single pair cable in the termination area of the carrier. Contacts 26 are arranged in a way to establish the strongest differential coupling which in turn helps reject unwanted coupling from outside sources of noise; the strong coupling is designed to comply with return loss characteristics as defined in IEEE and TIA standards. Arrangements of contacts 26 include but are not limited to parallel runs where contact faces are overlapping either side by side or top to bottom. One skilled in the art understands that parallel overlapping metal surface area results in the strongest electric field interaction. The carrier assembly also has a strain relief feature 28 designed to grip onto the outer jacket of the single pair cable jacket using ribs 30. This prevents the cable from separating from the connector and pulling out of the contact termination area. The contact carrier has an integrated wire cap 32 that uses a hinge feature 34 to allow the wire cap to pivot down and apply pressure to the cable conductors to drive them into their respective insulation displacement contacts 36 to establish electrical continuity. Ramp feature 38 applies force down onto the wire cap as the carrier assembly is pushed into outer housing 12. Wire cap 32 has similar strain relief ribs 30 to the main body 24 to grip the top of the cable jacket as the carrier assembly is inserted into the outer housing termination area 14.

Figure 7:
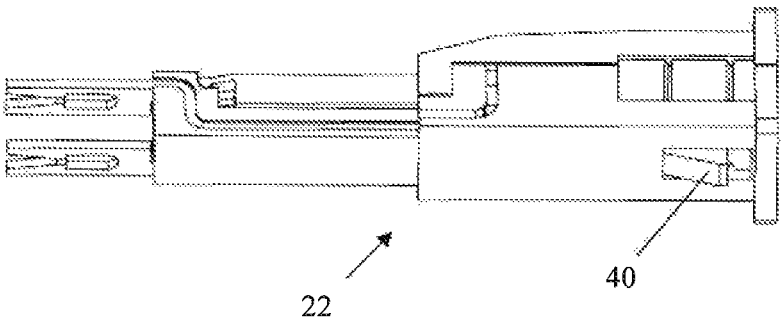
FIG. 7 is a side view of the contact carrier assembly of FIG. 6.

FIG. 7 shows the underside of the contact carrier 22 which has a latch 40 that engages with slot 21 of the shielding wrap 18 to lock the carrier into the connector housing.

Figure 8:
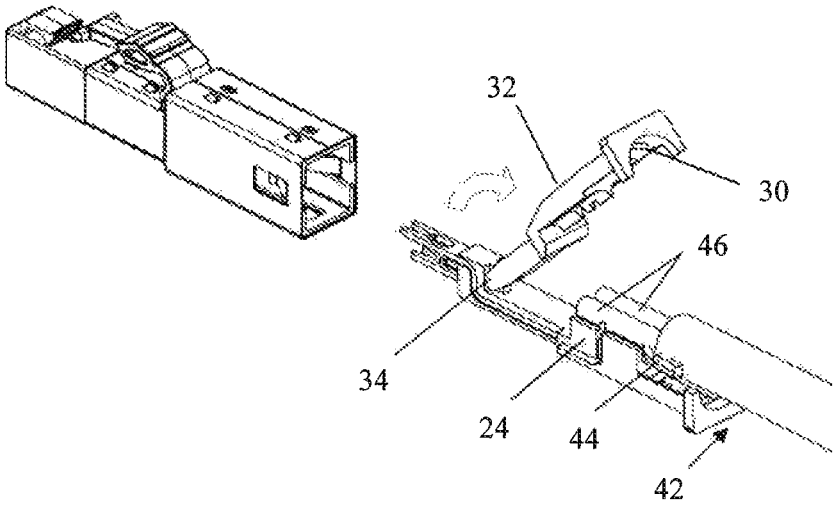
FIG. 8 is an isometric view of the single pair ethernet connector of FIG. 2 showing the termination of a cable to the contact carrier assembly.
Figure 9:
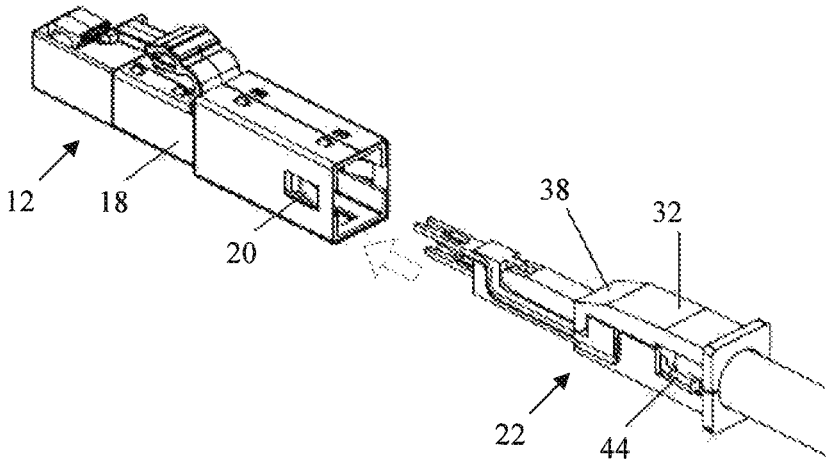
FIG. 9 is an isometric view of the single pair ethernet connector of FIG. 2 showing the insertion of contact carrier assembly with a terminated cable into the outer housing.
Figure 10:
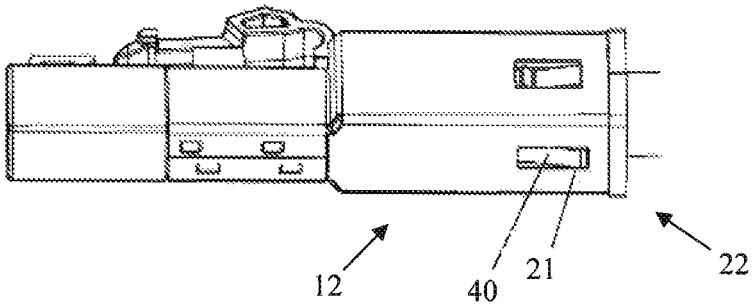
FIG. 10 is a side and bottom view of the single pair ethernet connector of claim 2 highlighting how a latch locks the contact carrier assembly into the outer housing.

FIGS. 8-10 illustrate the procedure for terminating the connector onto a single pair cable 42. The first step of the termination is shown in FIG. 8. The outer jacket of cable 42 is stripped back and shielding screen 44 is pulled back along the outer diameter of the cable. Conductors 46 are trimmed to a prescribed length and placed in channels 27 of carrier main body 24. The wire cap 32 is then pivoted about hinge feature 34 down onto the conductors 46, driving them into the insulation displacement contacts 36 and establishing electrical continuity. Simultaneously, the ribs 30 of wire cap 32 grip onto the outer cable jacket.

Once the wire cap 32 has been pivoted down and the insulation displacement contacts have pierced the cable conductor insulation, the contact carrier assembly 22 is inserted into the rear of the connector outer housing 12 as shown in FIG. 9. As the carrier assembly 22 is installed, ramp feature 38 applies force downward onto wire cap 32 to ensure the cable conductors are fully depressed into the insulation displacement contacts. The cable shielding screen 44 is exposed along the sides of contact carrier assembly 22, allowing it to make contact with tabs 20 of shielding wrap 18. The connection of tabs 20 and cable shielding screen 44 provides a continuity of grouding along the cabling system to eliminate unwanted conversions of differential signal to common mode signal. A collar 86 can aid in the insertion of the contact carrier assembly into the outer housing. One skilled in the art understands that any discontinuity or difference in ground reference results in unwanted common mode signal conversions.

FIG. 10 shows that the contact carrier assembly 22 is locked into the outer housing 12 via latch 40 on the carrier and slot 21 on the shield and connector housing.

Figure 11:
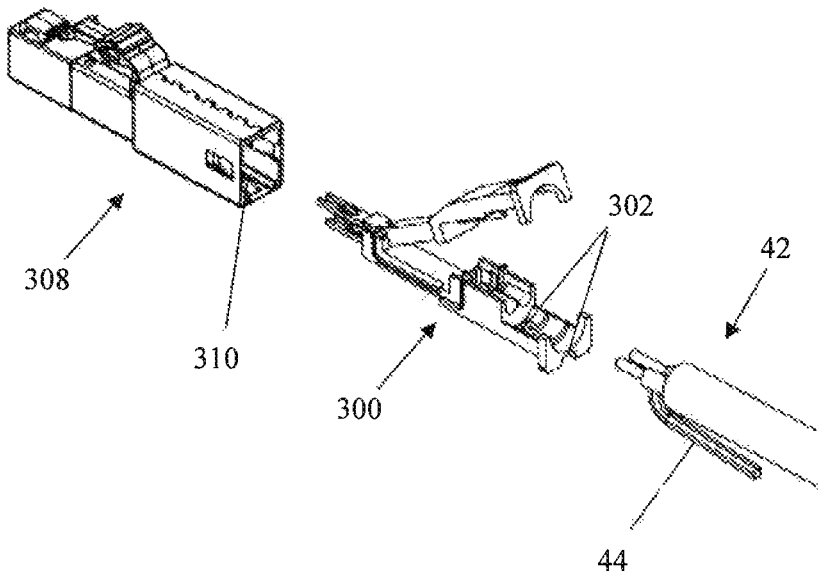
FIG. 11 is an exploded isometric view of a single pair ethernet connector with an alternate contact carrier assembly which has an added notch feature for strain relief.

FIG. 11 shows an assembly similar to that shown in FIGS. 2-7. In this embodiment, the contact carrier assembly 300 has a notch feature 302 in the strain relief area. This allows the cable screen 44 of single pair cable 42 to be routed outside of the contact carrier. The outer housing shielding wrap 308 has a tab 310 that makes contact with cable screen braid 304 for grounding once the contact carrier is inserted into the shield.

Figure 12:
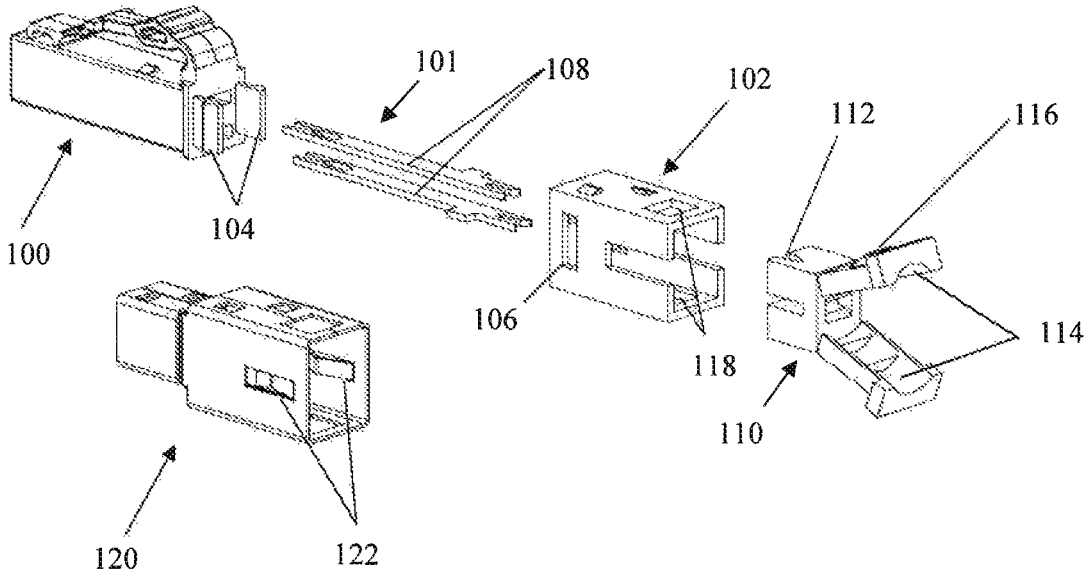
FIG. 12 is an exploded isometric flew of a first alternate embodiment of a single pair ethernet connector.

FIG. 12 shows a first alternate embodiment of the invention described above wherein the electrical contacts 101 are encapsulated in the outer housing 100 and held in place by a contact retainer 102. The contact retainer is secured to the outer housing by outer housing latches 104 that engage with contact retainer side notches 106. The insulation displacement contacts 108 are oriented horizontally and extend from the rear of the connector housing. The wire cap and cable strain relief are incorporated into a separate piece 110. The wire cap/strain relief holds the cable conductors perpendicular to the contact insulation displacement contacts with notches 112. As the user pushes the wire cap/strain relief into the rear of the connector, the conductors of the cable are pushed into the insulation displacement contacts 108 and establish electrical connection while simultaneously, the strain relief legs 114 grip onto the outer cable jacket. The wire cap/strain relief locks into the contact retainer using latch features 116 that engage with top and bottom notches 118. Shielding wrap 120 encompasses the outer housing and contact retainer and features grounding tabs 122 that contact the cable screen braid.

Figure 13:
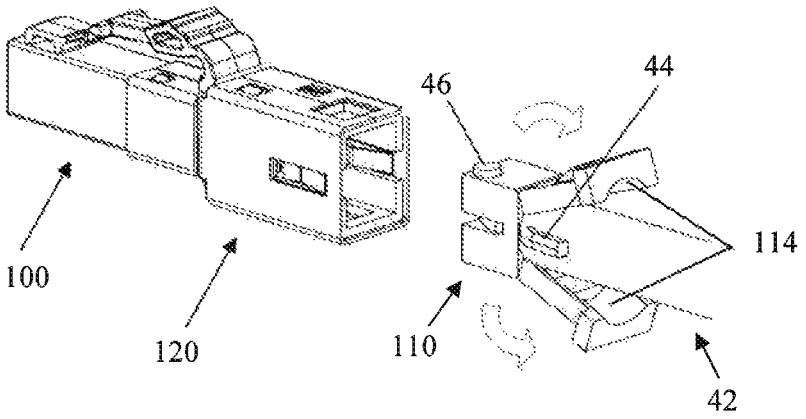
FIG. 13 is an isometric view of the single pair ethernet connector of FIG. 12 highlighting how a cable is inserted into the wire cap.
Figure 14:
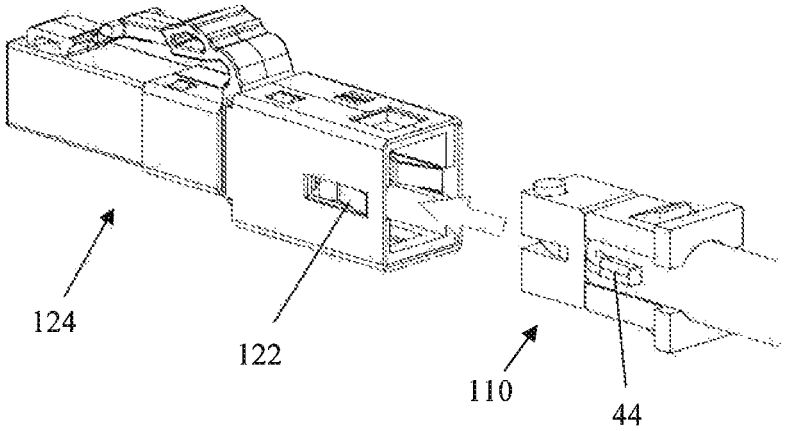
FIG. 14 is an isometric view of the single pair ethernet connector of FIG. 12 showing the insertion of the wire cap into the outer housing and contact retainer.
Figure 15:
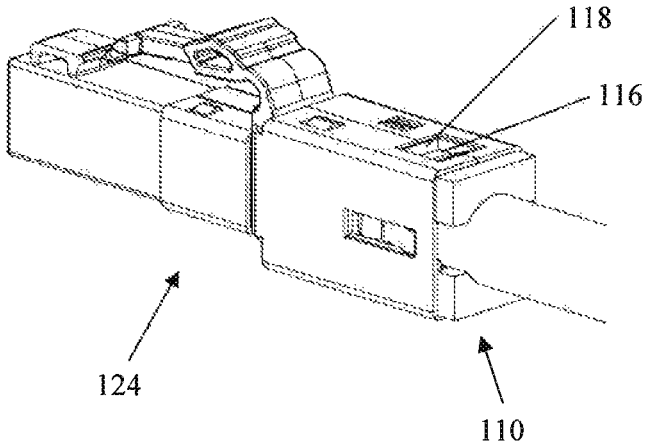
FIG. 15 is an isometric view of the single pair ethernet connector of FIG. 12 showing the wire cap fully inserted.

The termination process for this embodiment starts with FIG. 13. The user will receive the connectors with the outer housing 100, contacts 101, contact retainer 102, and shielding wrap 120 pre-assembled. The outer jacket of cable 42 is stripped back and shielding screen 44 is pulled back along each side of the cable. Conductors 46 are fed through the center of wire cap 110 and pushed into notches 112, then trimmed to be flush with the outside surface of the wire cap. Strain relief legs 114 are then pivoted down onto cable jacket and are used as a place for user to grip the wire cap as it is pushed into the back of the connector assembly. FIG. 14 shows the wire cap 110 with cable installed being inserted into the back of the connector assembly 124. The shielding screen 44 of cable 42 lines up with grounding tabs 122 of the shielding wrap, creating an electrical bond between the cable and connector when the wire cap is installed. After wire cap 110 is fully inserted into the connector assembly 124, the wire cap is locked into place via latch features 116 and contact retainer notches 118, as shown in FIG. 15.

Figure 16:
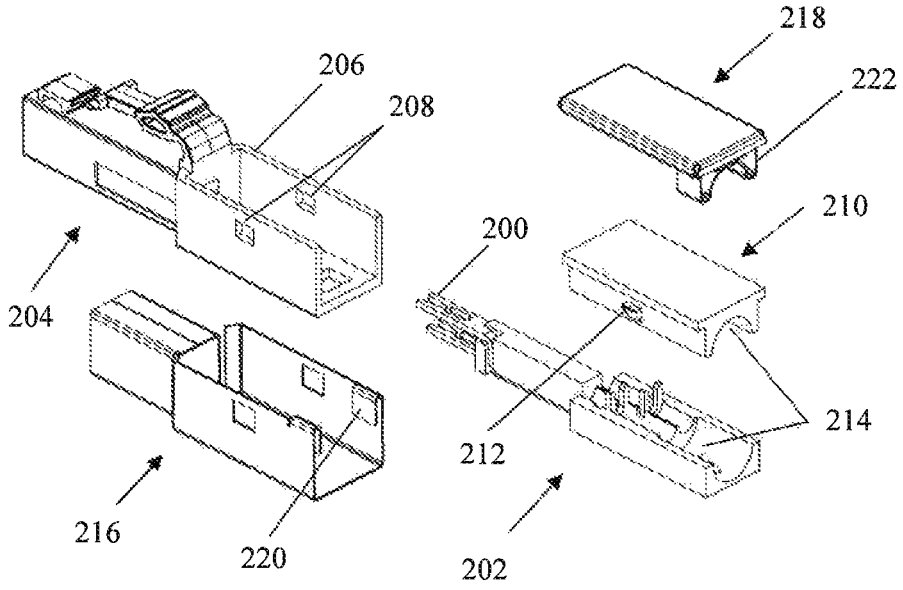
FIG. 16 is an exploded isometric view of a second alternate embodiment of a single pair ethernet connector.

FIG. 16 shows a second alternate embodiment and describes a termination method in which the contacts 200 are located in a plastic sled 202 that is inserted into the back of connector housing 204. The connector housing has vertical walls 206 that feature slots 208. After the plastic sled is inserted into the connector housing, a wire cap 210 is installed on the sled to establish cable conductor contact. The wire cap has latches 212 that engage with connector housing slots 208 to lock the wire cap in place. Plastic sled 202 and wire cap 210 have strain relief features 214 to support and retain the outer cable jacket. Housing shield 216 encompasses connector housing 204. The housing shield has tabs 220 that wrap inside of the connector housing walls that contact corresponding tabs 222 on wire cap shield 218. The wire cap shield tabs 222 wrap into the strain relief area to contact the cable screen, creating a fully grounded connection.

While particular embodiments and applications of the present invention have been illustrated and described, it is to be understood that the invention is not limited to the precise construction and compositions disclosed herein and that various modifications, changes, and variations may be apparent from the foregoing without departing from the spirit and scope of the invention as described.

The invention claimed is:

1. A communication connector comprising:

an outer housing;

a shielding wrap at least partially surrounding the outer housing;

a contact retainer containing at least two contacts with insulation displacement contacts (IDCs) contained within the outer housing; and a wire cap configured to be inserted into the outer housing in a same direction as the mating of the connector to an associated connector and contact retainer wherein the wire cap is further configured to orient conductors of a cable perpendicular to a direction of insertion of the cable into the wire cap and wherein the wire cap further has pivotally attached strain relief legs to provide strain releif to the cable when the wire cap is inserted into the contact retainer and outer housing.

* * * * *